US007441849B2

(12) United States Patent
Sasa et al.

(10) Patent No.: US 7,441,849 B2
(45) Date of Patent: Oct. 28, 2008

(54) DROPLET EJECTION APPARATUS

(75) Inventors: Masahiko Sasa, Nagoya (JP); Naohisa Kinoshita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/380,800

(22) Filed: Apr. 28, 2006

(65) Prior Publication Data

US 2006/0243930 A1 Nov. 2, 2006

(30) Foreign Application Priority Data

Apr. 28, 2005 (JP) ..... 2005-132193

(51) Int. Cl.
*B41J 25/308* (2006.01)

(52) U.S. Cl. ..... 347/8

(58) Field of Classification Search ..... 347/8
See application file for complete search history.

(56) References Cited

U.S. PATENT DOCUMENTS 5,004,928 A 4/1991 Suzuki et al.
6,137,503 A * 10/2000 Hashimoto et al. ..... 347/19
2005/0280665 A1 * 12/2005 Flotats et al. ..... 347/8

FOREIGN PATENT DOCUMENTS

JP 1989264871 A 10/1989
JP 1990056375 A 2/1990
JP 2003246500 A 9/2003

* cited by examiner

*Primary Examiner*—Julian D Huffman
(74) *Attorney, Agent, or Firm*—Baker Botts L.L.P.

(57) ABSTRACT

A droplet ejection apparatus which includes: a platen on which an ejection target medium is conveyed; a head that ejects droplets toward the platen, the head being provided in a reciprocable manner along the platen; a light emitting device that emits a light in an oblique direction toward the platen within a plane including a straight line along a moving direction of the head and a normal line with respect to the platen; a light receiving device that receives the light emitted from the light emitting device and regularly reflected by one of the platen and the ejection target medium; and a calculation device that calculates a distance between the one of the platen and the ejection target medium, and the head, based on a position at which the light receiving device receives the light during a movement of the head. One of the light emitting device and the light receiving device reciprocably moves integrally with the head, and the other is provided separately from the head.

10 Claims, 9 Drawing Sheets

DROPLET EJECTION APPARATUS

CROSS-REFERENCE TO RELATED APPLICATION

This application claims the benefit of Japanese Patent Application No. 2005-132193 filed Apr. 28, 2005 in the Japanese Patent Office, the disclosure of which is incorporated herein by reference.

BACKGROUND

The present invention relates in general to a droplet ejection apparatus that ejects droplets on an ejection target medium which is conveyed on a platen, and relates in particular to a droplet ejection apparatus capable of calculating a distance between a head for ejecting droplets and the platen or the ejection target medium.

There has been devised a technique in which a distance between an ejection target medium which is conveyed on a platen and a head for ejecting droplets is calculated and used for a variety of control. In a proposed example, a printing head for ejecting ink on a printing sheet as an ejection target medium is mounted on a carriage, and a sensor, including a light emitting portion, a first regular reflection light receiving portion and a second regular reflection light receiving portion, is also mounted on the carriage.

The first regular reflection light receiving portion is disposed at a position such that when a light emitted from the light emitting portion is reflected by a thick glossy paper as a printing sheet, the first regular reflection light receiving portion receives a regular reflection light.

The second regular reflection light receiving portion is disposed at a position such that when a light emitted from the light emitting portion is reflected by a thin glossy paper as a printing sheet, the second regular reflection light receiving portion receives a regular reflection light. Accordingly, calculation of a distance between the printing sheet and the head can be performed by comparing a light receiving amount of the first regular reflection light receiving portion and a light receiving amount of the second regular reflection light receiving portion.

The above described configuration, however, requires a plurality of light receiving portions to be provided. This leads to an increase in manufacturing cost and inefficiency in assembly operation. Providing a plurality of light receiving portions also leads to an increase in size of the carriage, which does not comply with a requirement to downsize an entire droplet ejection apparatus. Furthermore, since the positional relationship between the light emitting portion and the first regular reflection light receiving portion or the second regular reflection light receiving portion is fixed, accurate calculation of the above-mentioned distance is unlikely to be performed when a printing sheet to be used has an intermediate thickness between the thickness of the thick glossy paper and the thickness of the thin glossy paper.

Providing an increased number of reflection light receiving portions will allow more accurate calculation of the above-mentioned distance even in the case of using a printing sheet having an intermediate thickness. This, however, will lead to a further increase in manufacturing cost.

These days, there is a demand for calculating not only the distance between the head and the ejection target medium, but also the distance between the head and the platen. This results from the facts that the distance between the platen and the head actually varies in individual products and that the height of the platen is adjustable in a recently proposed model.

SUMMARY

One aspect of the present invention may provide a droplet ejection apparatus capable of accurately calculating a distance between a head for ejecting droplets and a platen or an ejection target medium without providing a multiplicity of light receiving portions or light emitting portions.

In the one aspect of the present invention, there is provided a droplet ejection apparatus comprising a platen, a head, a light emitting device, a light receiving device and a calculation device. An ejection target medium is conveyed on the platen. The head is provided in a reciprocable manner along the platen, and ejects droplets toward the platen. The light emitting device emits a light in an oblique direction toward the platen within a plane including a straight line along a moving direction of the head and a normal line with respect to the platen. The light receiving device receives the light emitted from the light emitting device and regularly reflected by one of the platen and the ejection target medium. The calculation device calculates a distance between the one of the platen and the ejection target medium, and the head, based on a position at which the light receiving device receives the light during a movement of the head.

One of the light emitting device and the light receiving device is adapted to reciprocably move integrally with the head. The other one of the light emitting device and the light receiving device is provided separately from the head.

According to the present invention configured as above, the light emitting device emits a light in an oblique direction toward the platen within a plane including a straight line along a moving direction of the head and a normal line with respect to the platen, while the light receiving device receives the light emitted from the light emitting device and regularly reflected by one of the platen and the ejection target medium. One of the light emitting device and the light receiving device reciprocably moves integrally with the head, while the other one is provided separately from the head.

Accordingly, the light receiving device receives the light which is regularly reflected when the head is moved to a predetermined position in accordance with a distance between the platen or the ejection target medium, and the head. Then, the calculation device calculates the distance between the platen or the ejection target medium, and the head, based on the position at which the light receiving device receives the light during the movement of the head.

According to the present invention, the calculation of the distance can be performed by providing at least one light emitting device and at least one light receiving device. Also, since the calculation is performed based on the position of the head when the light receiving device receives the light, an accurate calculation can be made even if the distance has an intermediate value. The present invention, therefore, will allow an accurate calculation of the distance between the platen and the head without causing a cost increase.

BRIEF DESCRIPTION OF THE DRAWINGS

A preferred embodiment of the present invention will be described hereinafter with reference to the drawings, in which.

DETAILED DESCRIPTION OF THE PREFERRED EMBODIMENT

[Overall Structure of the Inkjet Recording Apparatus 1]

An inkjet recording apparatus 1 is a so-called multifunction device (MFD: Multi Function Device) including a printer function, a copier function, a scanner function, a facsimile function and others. A sheet P, such as a plain paper, an envelope, a plastic film, is used as an ejection target medium.

Figure 1:
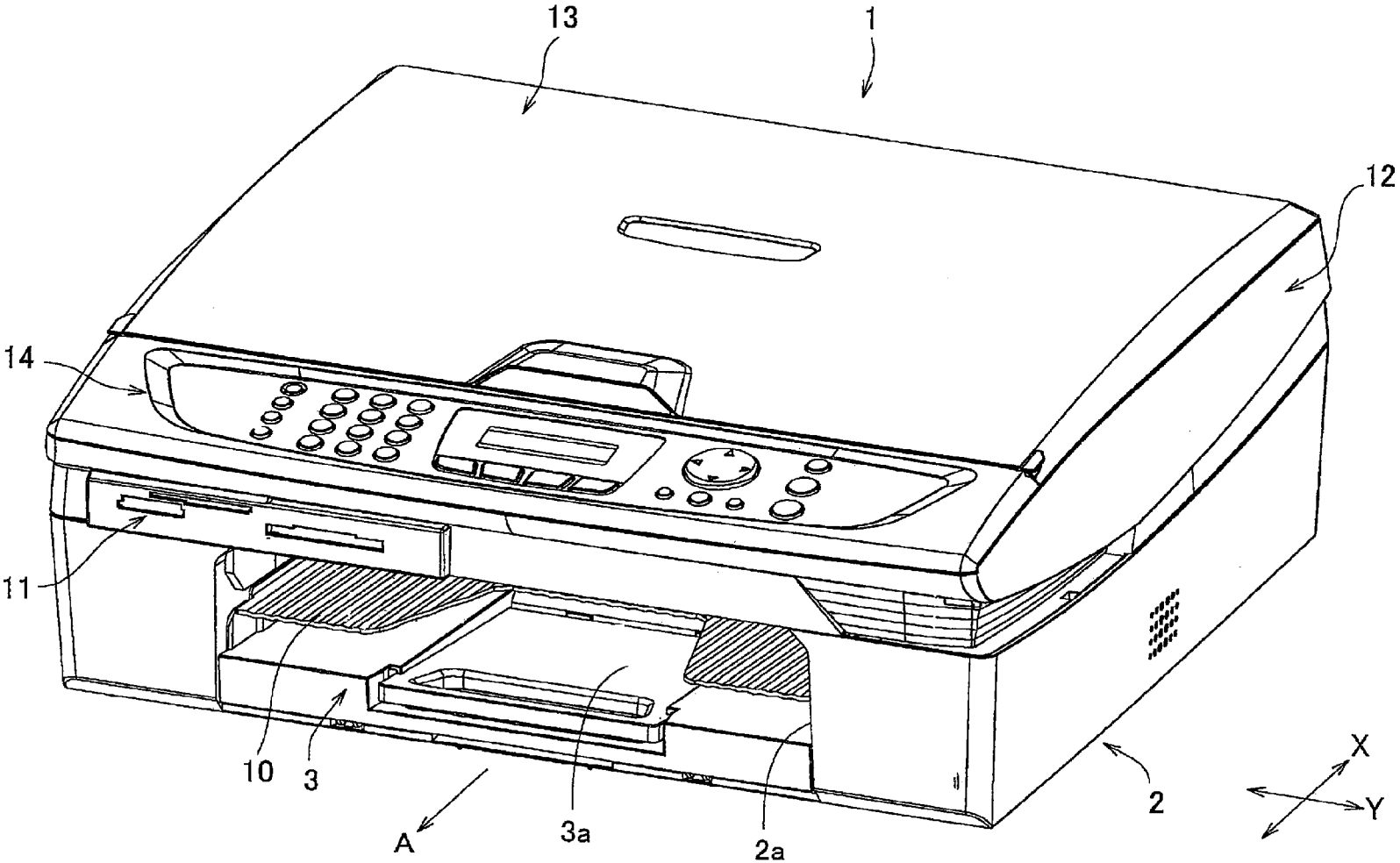
FIG. 1 is a perspective view showing an appearance of an inkjet recording apparatus according to the present invention.

As shown in FIG. 1, the inkjet recording apparatus 1 comprises a housing 2 of synthetic resin and a sheet feed cassette 3, which can be inserted into the housing 2 through an opening 2*a* formed in a front and lower portion of the housing 2. A sheet discharge portion 10 for discharging the sheet P after recording in the direction of an arrow A is provided above the sheet feed cassette 3. A sheet discharge port in communication with the sheet discharge portion 10 is provided in an upper portion of the opening 2*a* in the front portion of the housing 2.

The sheet feed cassette 3 is configured so as to contain a plurality of sheets P cut into, for example, A4 size, letter size, legal size, postcard size, etc. Sheets P in each size are placed such that a longitudinal side of each sheet is parallel with a sheet conveying direction (a sub scanning direction or an X-axis direction) and a left longitudinal side of each sheet in FIG. 1 is aligned according to a so-called side registration system. An auxiliary support member 3*a* for supporting a rear end portion of a relatively long sheet P like a paper in legal size, or the like is attached to a front end of the sheet feed cassette 3 such that the auxiliary support member 3*a* is capable of extending in the direction of X. In the case of using sheets P in A4 size or the like capable of being housed within the sheet feed cassette 3, the auxiliary support member 3*a* can be retracted from the front end of the sheet feed cassette 3.

An image scanner 12, which is used in scanning documents to achieve the copier function or the facsimile function, is disposed in an upper portion of the housing 2. The image scanner 12 is configured so as to be rotatable upwardly and downwardly in opening and closing directions with respect to one side end of the housing 2 via a not-shown axis portion. Also, a document cover 13 to cover all over the top surface of the image scanner 12 is attached so as to be rotatable upwardly/downwardly around a not-shown axis provided at a rear end of the image scanner 12.

To perform image scanning, the document cover 13 is opened upwardly, and a document is placed on a placement glass plate. Then, a contact image sensor (CIS: Contact Image Sensor) for document scanning, provided so as to be reciprocable along a Y-axis direction (i.e., a main scanning direction) under the placement glass plate, scans a document surface thereby to read an image on the document surface. It is preferable to close the document cover 13 when image scanning of the document is performed.

An operation panel 14, including various operation buttons and a liquid crystal display portion, is disposed in a front portion of the document cover 13 over the top surface of the image scanner 12. An external memory insertion portion 11 for inserting an external memory therethrough is provided in a front surface of the housing 2 and below the operation panel 14. The external memory here means, for example, a Compact Flash®, a Smart Media®, a Memory Stick®, an SD Card®, an xD® or the like.

Figure 2:
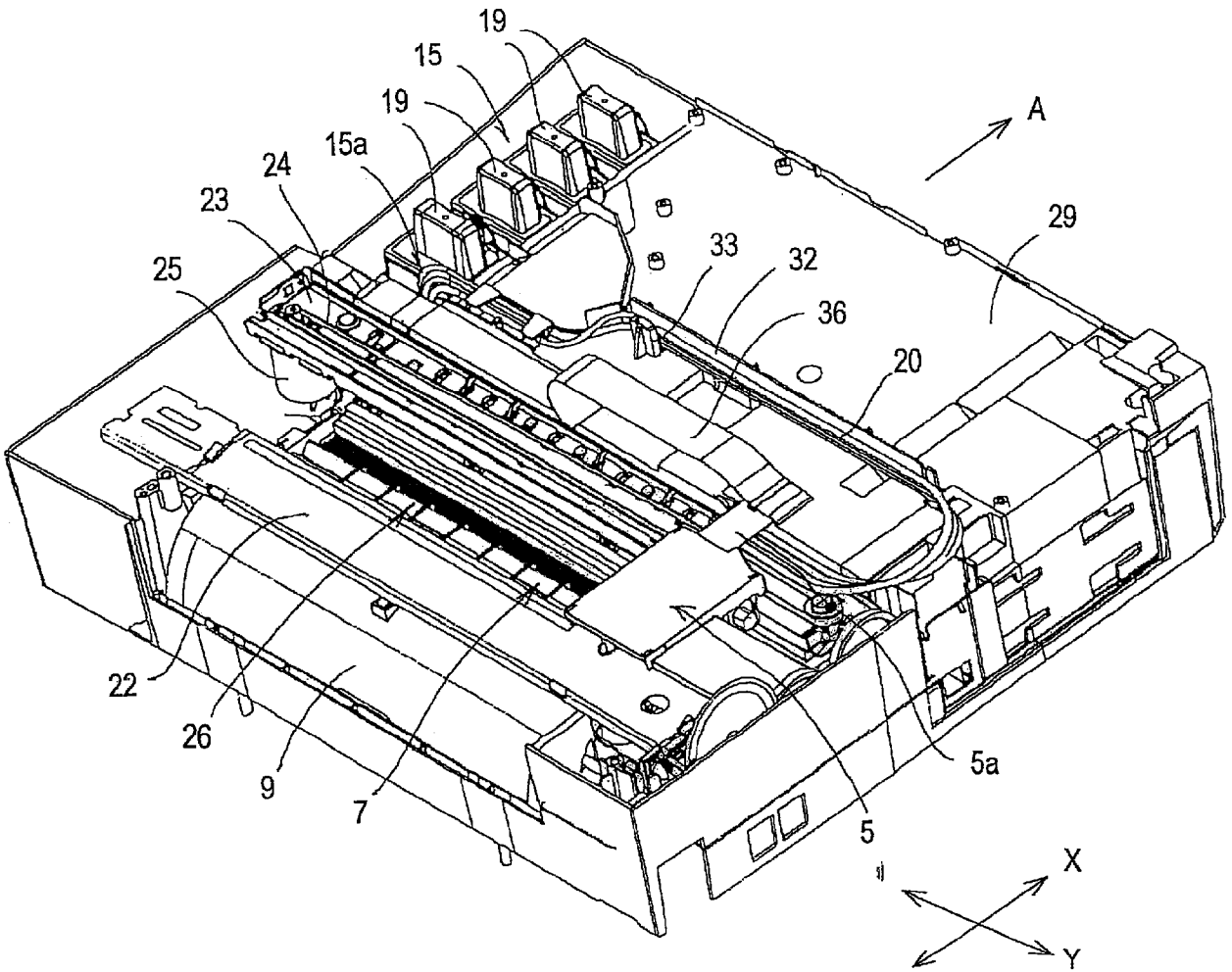
FIG. 2 is a perspective view showing a structure around a recording unit inside the inkjet recording apparatus.
Figure 4A:
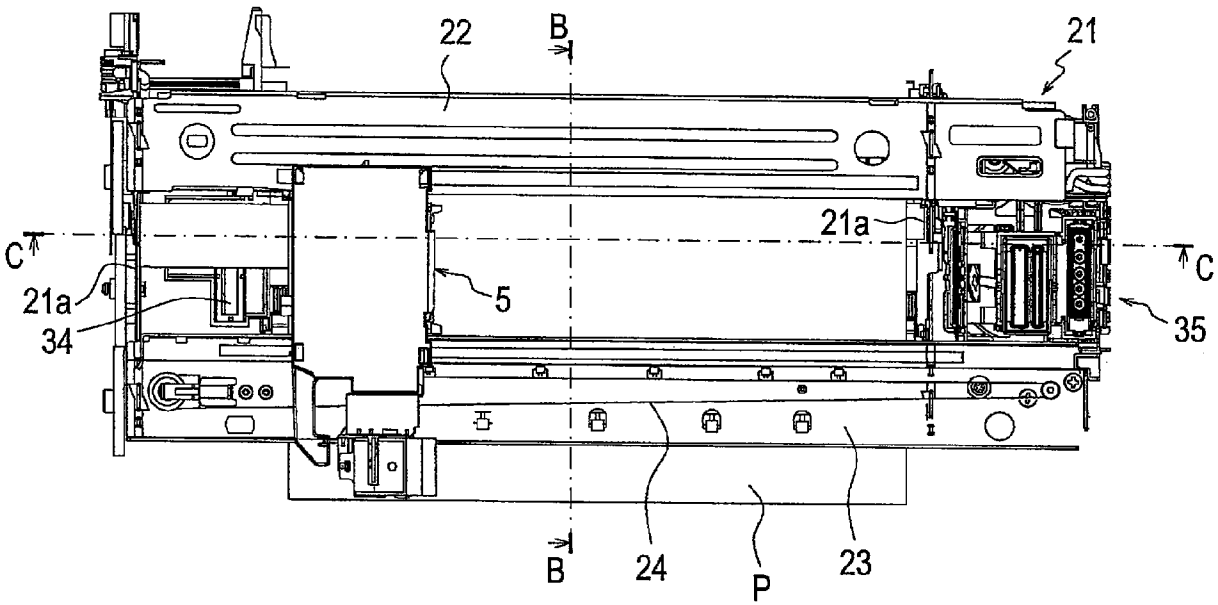
FIG. 4A is a plan view of the recording unit.

As shown in FIG. 2, a recording unit 7 including a carriage 5 and other mechanisms is provided inside the housing 2. The carriage 5 is reciprocable along the Y-axis direction (the main scanning direction), and a recording head 4 of an inkjet type (see FIG. 4) for achieving the printer function is mounted on the carriage 5. The sheets P contained in the sheet feed cassette 3 are separated sheet by sheet by a not-shown sheet feed roller, and each separated sheet makes a U-turn in a U-turn path 9 and is conveyed to the recording unit 7. A further detailed explanation of the recording unit 7 will be provided later.

An ink reservoir portion 15 is provided in a front portion inside the housing 2 so as to be open upward. The ink reservoir portion 15 houses ink cartridges 19 containing four colors (black, cyan, magenta and yellow) of ink, respectively, for performing full-color recording. The ink cartridges 19 are aligned in a line along the X-axis direction. The ink cartridges 19 are configured to be attached to and detached from above the ink reservoir portion 15. To replenish ink of each color, the corresponding ink cartridge 19 is replaced with a new one. When the image scanner 12 is opened upward, replacement of the ink cartridge 19 may be performed by inserting a hand into the opened housing 2.

The inks contained in the ink cartridges 19 are supplied to the recording head 4 through four ink supply tubes 20 connecting the ink cartridges 19 and the recording head 4. In the case of using more ink colors than four (e.g., six colors or eight colors), the ink reservoir portion 15 may be configured to house a number of ink cartridges corresponding to the number of ink colors, and the number of the ink supply tubes 20 may be increased corresponding to the number of ink cartridges.

Respective one ends of the ink supply tubes 20 are connected to a connecting portion 5*a* of a base portion of the carriage 5. The other ends of the ink supply tubes 20 are bundled at one end portion 15*a* of the ink reservoir portion 15. The ink supply tubes 20 extend along the Y-axis direction on an upper surface of a lower cover 29. The ink supply tubes 20 are supported by the upper surface of the lower cover 29, a vertical partition plate 32 and a fixing member 33 provided on the lower cover 29 such that the ink supply tubes 20 can follow the reciprocating movement of the carriage 5.

A belt-like flexible flat cable 36 connected to the carriage 5 via the connecting portion 5 is disposed such that the flexible flat cable 36 can follow the reciprocating movement of the carriage 5. The flexible flat cable 36 is used to transmit a command signal from a control unit 100 (see FIG. 5) to selectively eject ink droplets from nozzles of the recording head 4 mounted on the carriage 5.

Figure 3:
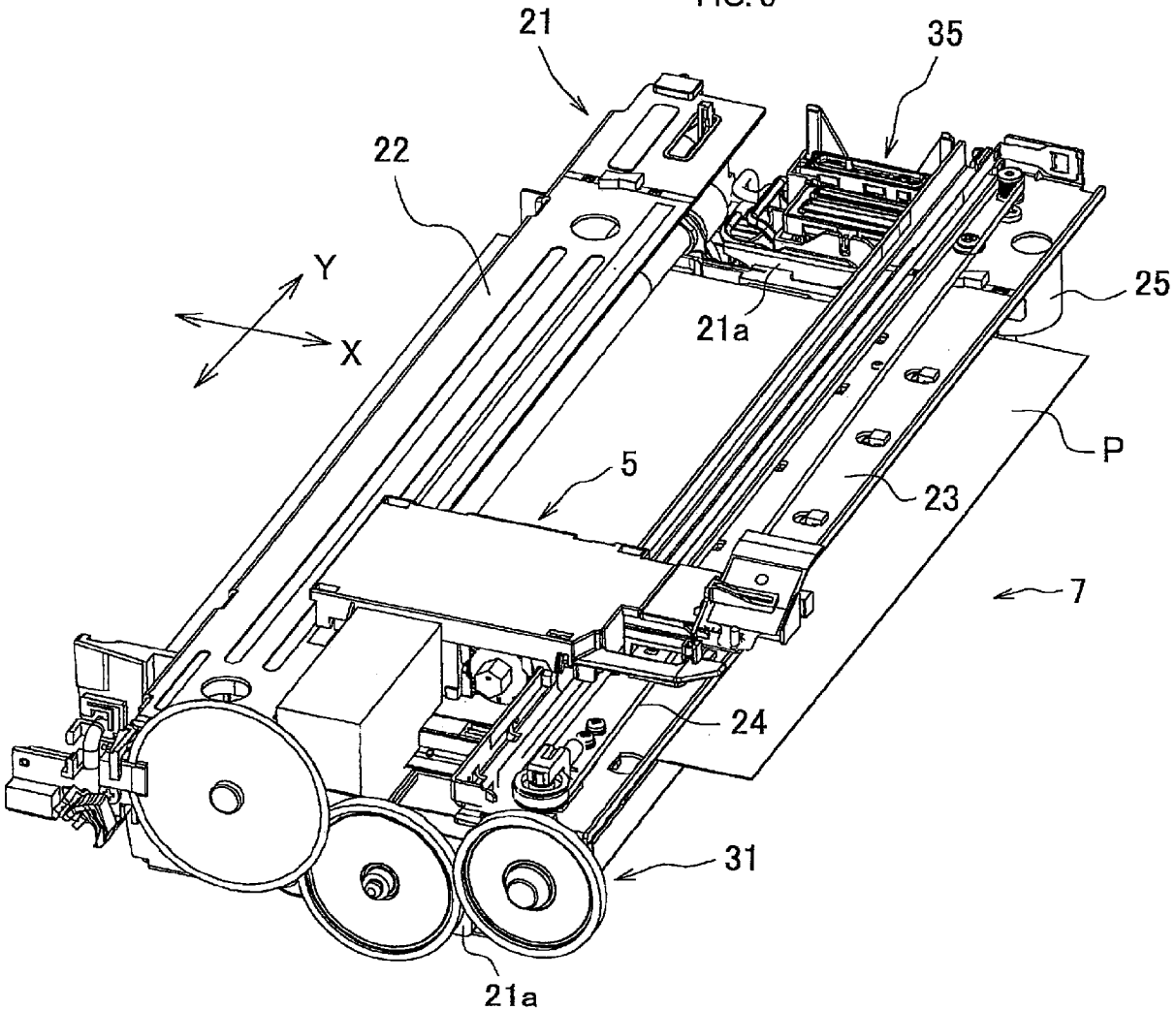
FIG. 3 is a perspective view showing a structure of the recording unit.
Figure 4C:
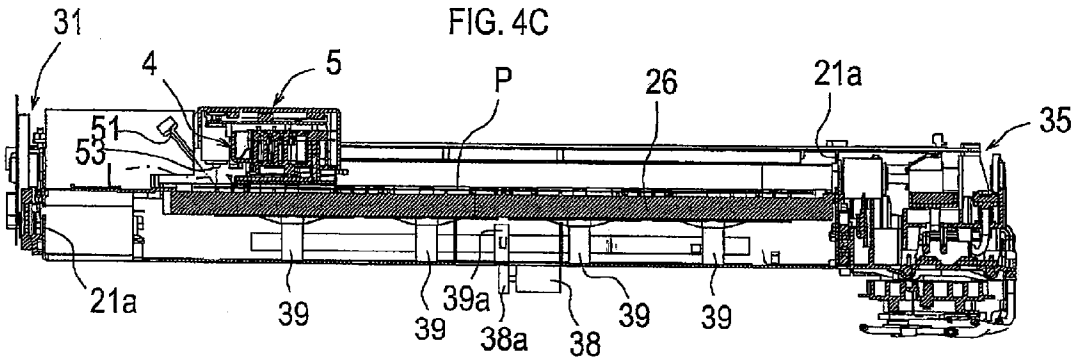
FIG. 4C is a cross-sectional view of the recording unit taken along line 4C-4C in FIG. 4A.
Figure 4B:
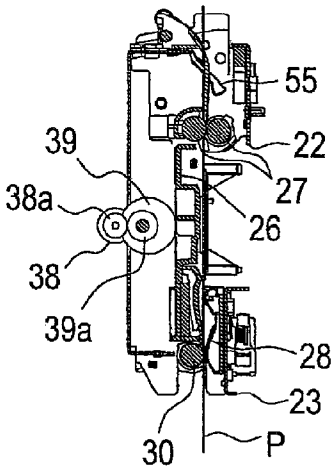
FIG. 4B is a cross-sectional view of the recording unit taken along line 4B-4B in FIG. 4A.

As shown in FIG. 3, the recording unit 7 includes plate-like guide members 22 and 23, the carriage 5, the recording head 4, a timing belt 24, a carriage motor 25, a platen 26 shown in FIG. 4B, an encoder strip and other mechanisms.

The guide members 22 and 23 are supported by a pair of left and right side panels 21*a* constituting a main frame 21 made of metal or the like, and extend horizontally along the Y-axis direction (the main scanning direction).

The carriage 5 is mounted in a bridging manner between the guide members 22 and 23 so as to be reciprocable along the main scanning direction. The recording head 4, as shown in FIG. 4C, is mounted on the carriage 5. The timing belt 24 is designed to transmit a drive power for reciprocating the carriage 5. The carriage motor 25 is designed to drive the carriage 5 through the timing belt 24. The platen 26 (see FIG. 4B) is a substantially flat plate-like member that supports the sheet P to be conveyed from under the recording head 4. The encoder strip is disposed to extend along the Y-axis direction (the main scanning direction) in order to detect a position of the carriage 5 along the Y-axis direction (the main scanning direction).

The carriage 5 is controlled by the control unit 100 to reciprocate along the Y-axis direction (the main scanning direction), thereby to scan the recording head 4. The recording head 4 ejects ink during the scanning to record an image on the sheet P stopped and located under the recording head 4. In this state, the sheet P is supported by the platen 26 constituting a conveying path of the sheet P. In other words, the recording head 4 is located right above the platen 26, and image recording on the sheet P by the recording head 4 is performed above the platen 26.

A waste ink receiver 34, which receives ink ejected during flushing operation performed by the recording head 4, is provided at a position outside a conveying area of the sheet P located on a left end side of the platen 26. A maintenance unit 35 is mounted at a waiting position of the carriage 5 on a right end side of the platen 26.

The recording head 4 periodically performs an ink ejection (flushing) during recording operation above the waste ink receiver 34 in order to prevent clogging of the nozzles, and the waste ink receiver 34 receives the ejected waste ink.

The maintenance unit 35 performs recovery processing, such as cleaning a nozzle surface of the recording head 4, selectively vacuuming each color of ink, and removing air bubbles from a not-shown buffer tank provided on the recording head 4.

In the nozzle surface (under surface) of the recording head 4, rows of nozzles are formed in appropriate intervals in the Y-axis direction. Each row of nozzles for each ink color includes a plurality of nozzles arranged along the X-axis direction. In the present embodiment, there are four rows of nozzles corresponding to the four ink colors, respectively, and the interval between the neighboring nozzles in each row is 75 dpi in the present embodiment.

As shown in FIG. 4B, the recording unit 7 includes a pair of regist rollers 27 disposed upstream from the platen 26 in the sheet conveying direction. A lever 55 for detecting a front edge of the sheet P is provided upstream from the pair of regist rollers 27.

While the sheet P conveyed from the sheet feed cassette 3 is fed through the U-turn path 9 to the regist rollers 27, the front edge of the sheet P pushes back the lever 55. Then, a not-shown sensor detects the front edge of the sheet P, and transmits a front edge detection signal to the control unit 100.

The sheet P conveyed to the regist rollers 27 is further conveyed to a position under the recording head 4, while being supported by the platen 26 from below. When ink is ejected from the recording head 4 in accordance with an ink ejection command from the control unit 100, recording is performed on the sheet P. A spur roller holder 28 holding a spur roller (not-shown) to contact an upper surface of the sheet P and a sheet discharge roller 30 to contact an under surface of the sheet P are disposed downstream from the platen 26 in the sheet conveying direction. The sheet P after recording is conveyed by the spur roller and the sheet discharge roller 30 to the sheet discharge portion 10 (see FIG. 1). Each of the above described rollers is driven by a conveyance motor 37 (see FIG. 5) through a gear mechanism 31 held by the left side panel 21*a*.

The platen 26 is held by the side panels 21*a* in a vertically movable manner. An eccentric cam 39, which is rotatingly driven by engagement of a gear 38*a* provided on a rotating shaft of a platen drive motor 38 with a gear 39*a*, is provided on an undersurface of the platen 26. When the eccentric cam 39 is rotated by driving the platen drive motor 38, the platen 26 is moved in upper and lower directions so as to adjust the distance between the platen 26 and the recording head 4.

[Configuration of the Control System of the Inkjet Recording Apparatus 1]

On a left side of the conveying area of the sheet P, a light emitting element 51 including an LED is provided. The light emitting element 51 emits an outgoing light L in an oblique direction toward the platen 26 within a plane including a straight line along the moving direction of the carriage 5 and a normal line with respect to the platen 26. A light receiving element 53 is disposed in a portion of the carriage 5 such that the light receiving element 53 is perpendicularly opposed to an irradiated portion on the platen 26 irradiated by the outgoing light L when the carriage 5 is moved to a left end. The light receiving element 53 receives regularly reflected light or diffusely reflected light of the outgoing light L reflected by the platen 26 or by the sheet P.

Figure 5:
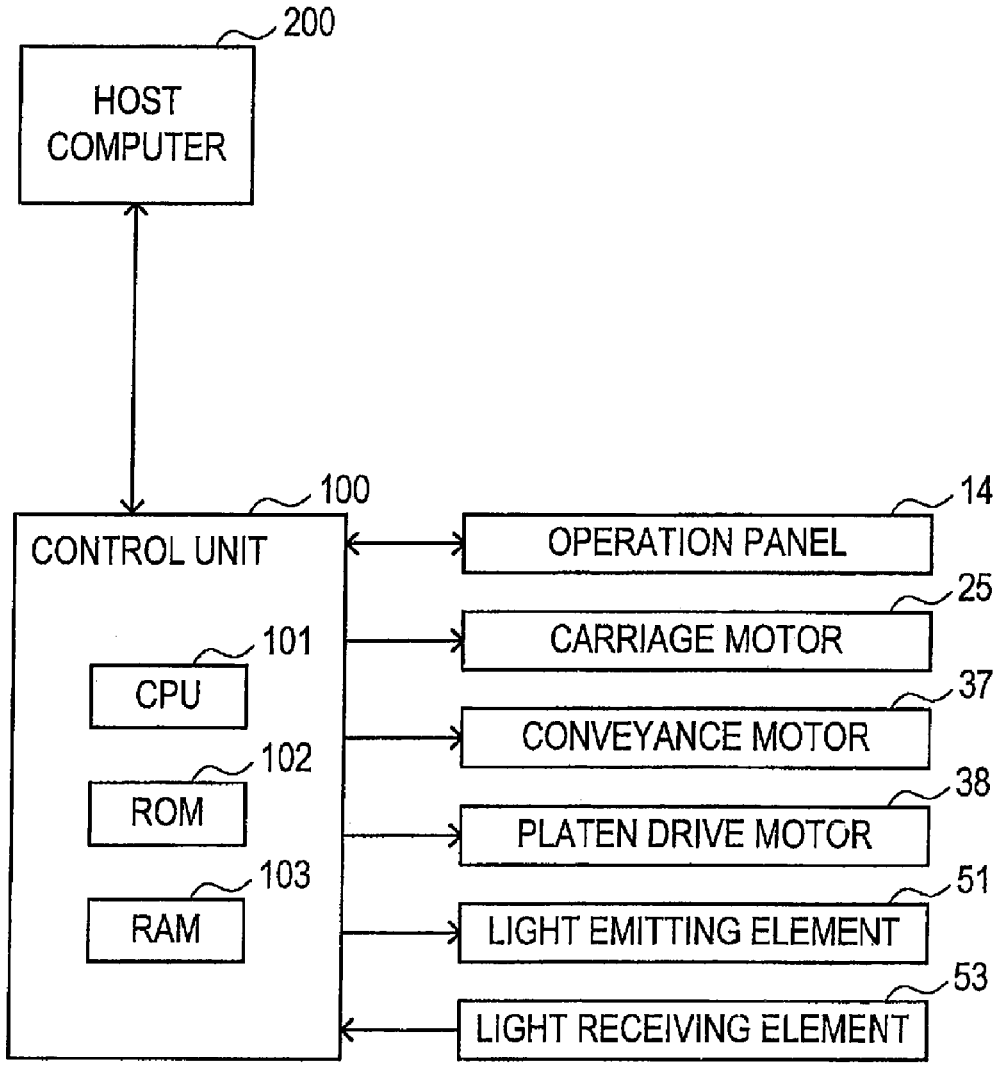
FIG. 5 is a block diagram showing a configuration of a control system of the inkjet recording apparatus.

The light emitting element 51 and the light receiving element 53 as well as the above-mentioned operation panel 14, the carriage motor 25, the conveyance motor 37 and the platen drive motor 38 are connected to the control unit 100, as shown in FIG. 5. Although various actuators and sensors, including an actuator of the recording head 4 and a sensor provided to the lever 55, are also connected to the control unit 100, such actuators and sensors are not shown in the drawings since there is no direct relation with the control to be described hereinafter.

The control unit 100, which is configured as a microcomputer, including a CPU 101, a ROM 102 and a RAM 103, is also connected to a host computer 200 through a not-shown interface. In the control unit 100 configured as above, the CPU 101 performs the following control based on programs stored in the ROM 102.

[Control in the Control System]

Figure 6:
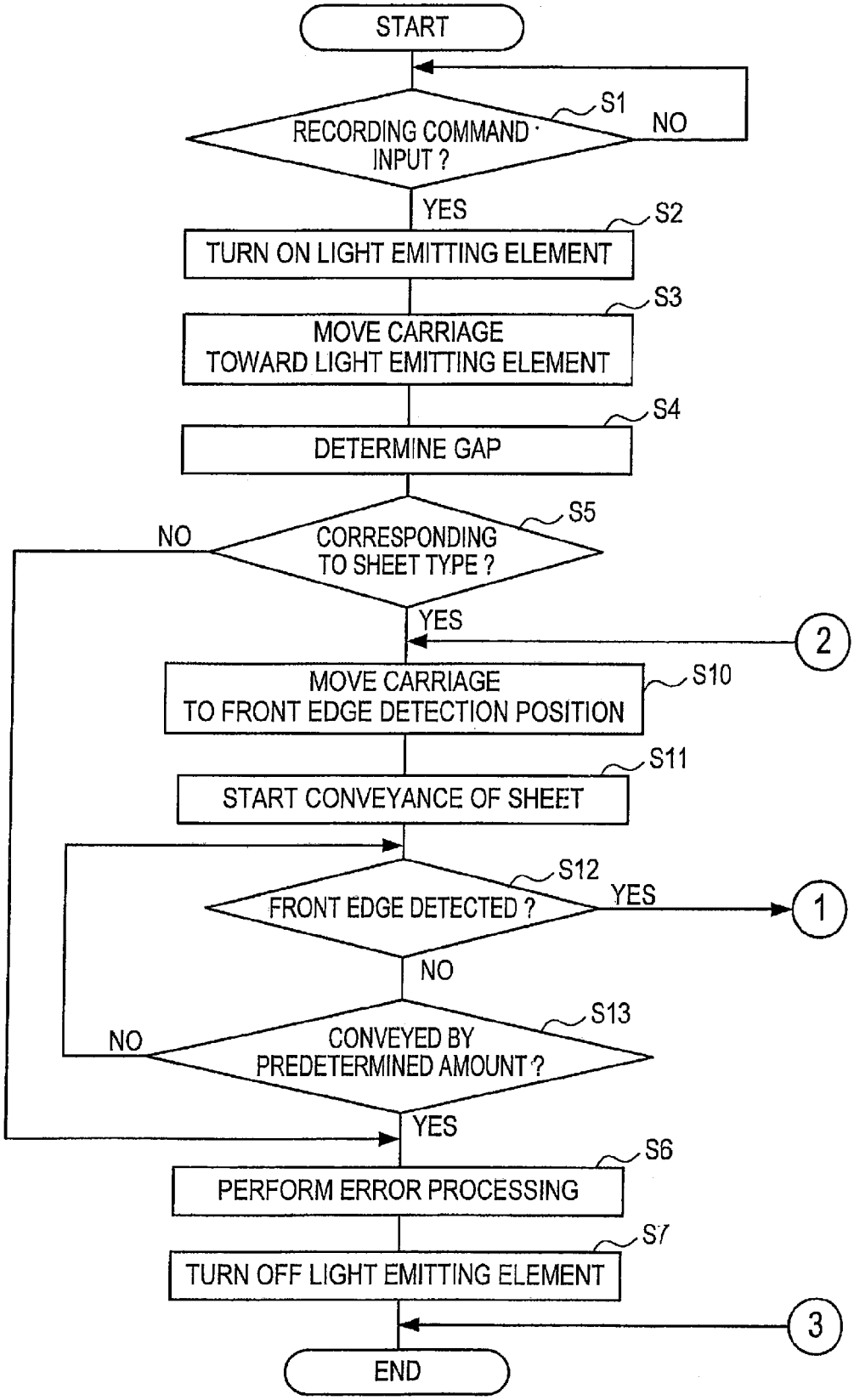
FIG. 6 is a flowchart for illustrating a part of a process performed by the control system.
Figure 7:
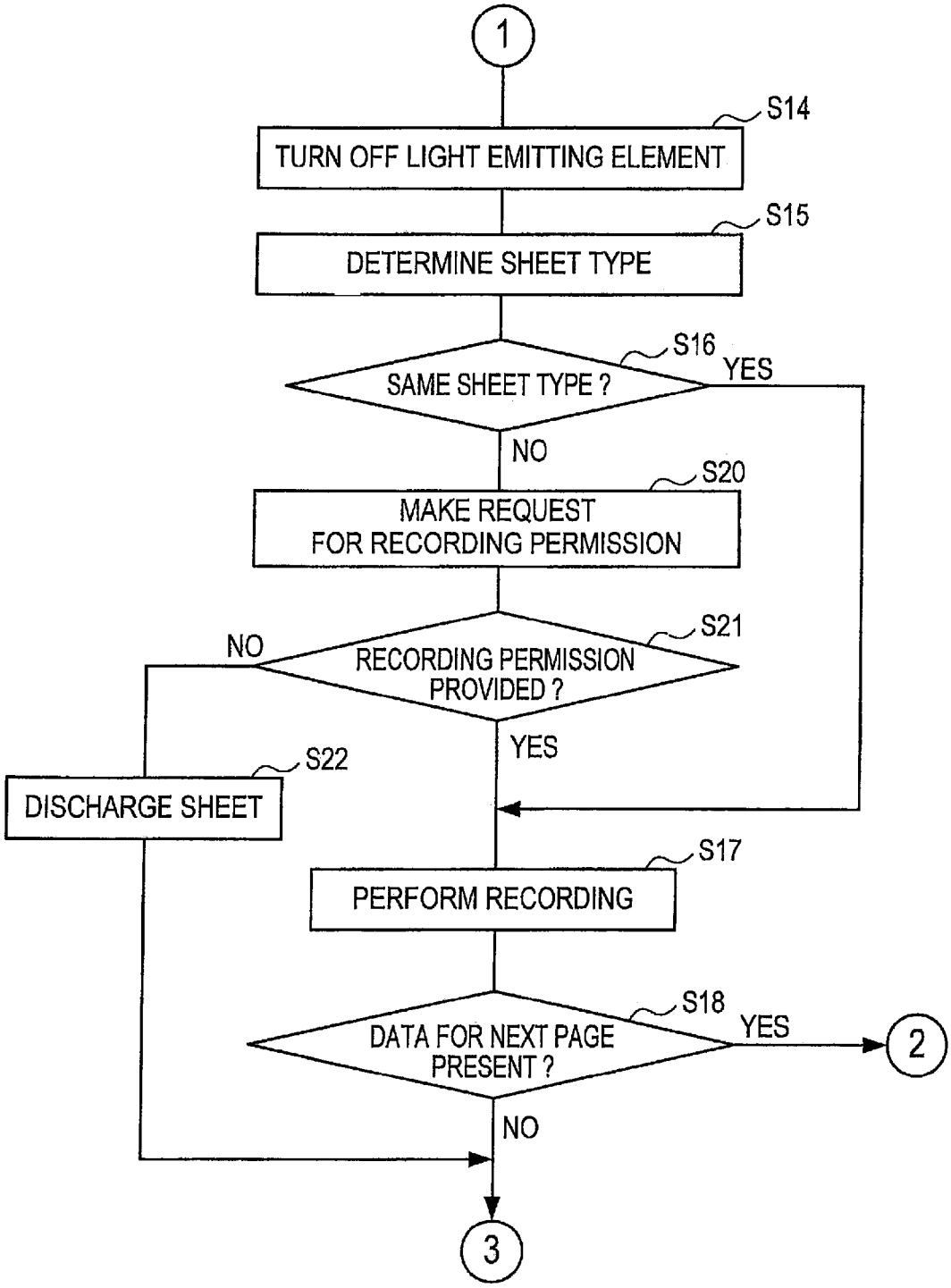
FIG. 7 is a flowchart for illustrating the remaining part of the process performed by the control system.

The control performed in the control unit 100 will now be described with reference to the flowcharts in FIGS. 6 and 7. To perform recording by the inkjet recording apparatus 1, setting of a sheet type as a target of recording is first performed based on an operation of the operation panel 14 by a user or on a command from the host computer 200. Once the setting of the sheet type is performed, the control unit 100 performs, as a preprocessing, a processing of driving the platen drive motor 38 to adjust the height of the platen 26. That is, the distance between the recording head 4 and the platen 26 is adjusted in accordance with the sheet-type, such as plain paper, thick paper, envelope, etc.

After the preprocessing as above, a recording command with data to be recorded is input from the host computer 200. In the process shown in FIGS. 6 and 7, it is first determined whether or not a recording command has been input in S1 (S means "Step"; the same hereinafter). When it is determined that a recording command has been input (S1: Y), the present process proceeds to S2, in which the light emitting element 51 is turned on. In subsequent S3, the carriage motor 25 receives a command and the carriage 5 is moved from the waiting position at the right end toward the light emitting element 51 (i.e., in a left direction).

While the carriage 5 is moved, the light receiving element 53 receives a light of the outgoing light L regularly reflected by the platen 26. In S4, the distance between the recording head 4 and the platen 26 (hereinafter also simply referred to as "gap") is determined based on a position of the carriage 5 when the light receiving element 53 receives the outgoing light L in a following manner.

Figure 8A:
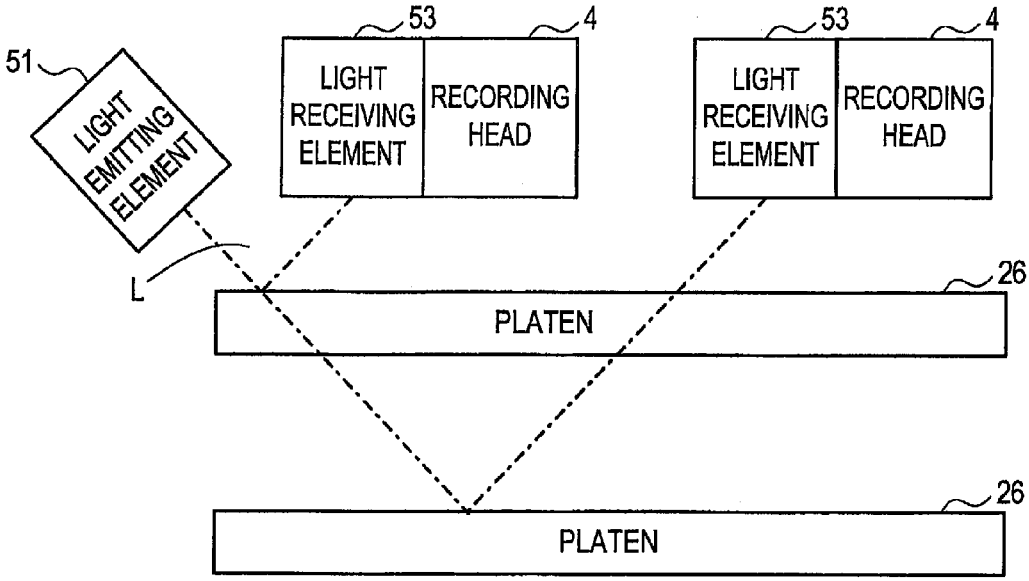
FIGS. 8A and 8B are explanatory views diagrammatically showing the principle of the process.

As grammatically shown in FIG. 8A, a position of the recording head 4 (i.e., a position of the carriage 5), when the outgoing light L emitted from the light emitting element 51 is regularly reflected by the platen 26 and the reflected light reaches the light receiving element 53, varies depending on the distance between the recording head 4 and the platen 26. Accordingly, the gap is calculated based on, the position of the carriage 5 when the light receiving element 53 receives the outgoing light L in S4.

In subsequent S5, it is determined whether or not the gap determined in S4 is consistent with a gap corresponding to the sheet type set as described above. If it is determined NO (S5: N), it is assumed that the preprocessing has not been performed appropriately. Then, the present process proceeds to S6, in which a known error processing is performed. Then, in S7, the light emitting element 51 is turned off and the present process is terminated.

On the other hand, when it is determined that the gap determined in S4 is consistent with a gap corresponding to the sheet type (S5: Y), the carriage 5 is moved to a front edge detection position at the left end in S10. In subsequent S11, a command is input to the conveyance motor 37, and conveyance of the sheet P is started. Once the conveyance of the sheet P is started, it can be determined by the light receiving element 53 whether or not a front edge of the sheet P has reached a position opposed to the recording head 4 in a following manner.

Figure 8B:
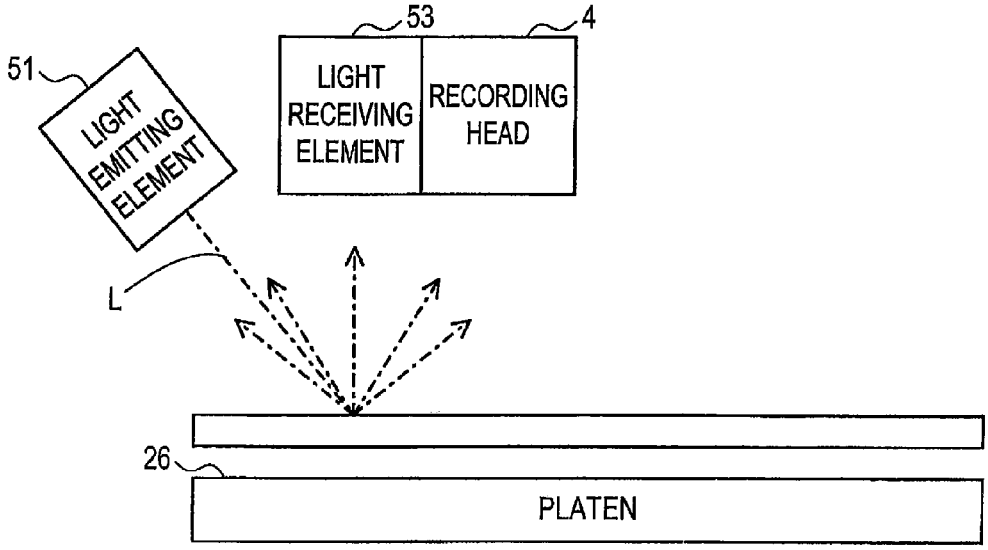

When the carriage 5 is located at the front edge detection position, almost all the outgoing light L emitted from the light emitting element 51 is regularly reflected by the platen 26. Accordingly, in S4, the light receiving element 53 does not receive the outgoing light L. In contrast, when the sheet P is conveyed to a position opposed to the recording head, the outgoing light L emitted from the light emitting element 51 falls on the sheet P. Then, the outgoing light L is diffusely reflected by the sheet P, and is partially received by the light receiving element 53, as grammatically shown in FIG. 8B.

In S12 subsequent to S11, it is determined whether or not the front edge of the sheet P has been conveyed to the position opposed to the recording head 4, based on a detection signal from the light receiving element 53. When it is determined that the front edge has not been detected (S12: N), it is then determined in S13 whether or not the sheet P has been conveyed by a predetermined amount, based on a driving state of the conveyance motor 37. When it is determined NO (S13: N), the present process returns to S12.

The above-mentioned predetermined amount is set at an amount of conveyance such that the sheet P may be conveyed to the position opposed to the recording head 4 within the amount of conveyance. Accordingly, if the sheet P has been conveyed by the predetermined amount without the front edge being detected while the processings in S12 and S13 are repeated (S13: Y), there is a possibility that a trouble such as jam in the conveying path of the sheet P has occurred. In this case, the present process proceeds to above described S6, and the error processing is performed. Then, in S7, the light emitting element 51 is turned off, and the present process is terminated.

Normally, the front edge is detected while the processings in S12 and S13 are repeated (S12: Y), and the light emitting element 51 is turned off in S14. Then, in S15, determination of the sheet type is performed. The diffusely reflected outgoing light L to be used for the front edge detection will have a different light amount which reaches the light receiving element 53, depending on the sheet type. For example, a glossy sheet P such as a film will cause a low diffusive reflection, while a plain paper or a Japanese paper will cause a high diffusive reflection. Therefore, in S15, the sheet type of the sheet P is determined based on the light amount of the diffusely reflected outgoing light L which is detected when it is determined YES in S12.

In S16, it is determined whether or not the sheet type determined in S15 is the same as the sheet type previously set as described above. When it is determined YES (S16: Y), the present process proceeds to S17, in which a known recording processing on the conveyed sheet P is performed. When the recording on the conveyed sheet P is completed, the present process proceeds to S18. In S18, it is determined whether or not data for the next page is present. When it is determined that data for the next page is present (S18: Y), the present process proceeds to S10, and the above described processings are performed again. When it is determined that data for all pages has been recorded and data for the next page is not present (S18: N), the present process is terminated.

On the other hand, when it is determined that the sheet type determined in S15 is not the same as the sheet type previously set (S16: N), the present process proceeds to S20. In S20, a request for a recording permission is made to the user through the operation panel 14 or the host computer 200. In S21, it is determined whether or not the user has provided, in response to the request, a recording permission through the operation panel 14 or the host computer 200. When it is determined that the user has provided a recording permission (S21: Y), the present process proceeds to S17, in which recording is performed. When it is determined that the user has not provided a recording permission (S21: N), the sheet P is discharged in S22, and the present process is terminated.

According to the present embodiment, as described above, the gap is determined based on a position of the carriage 5 when the light receiving element 53 receives the outgoing light L regularly reflected by the platen 26 while the carriage 5 is moved from the waiting position toward the light emitting element 51. Accordingly, the gap can be determined by using a set of the light emitting element 51 and the light receiving element 53, and an accurate determination of the gap can be made even if the gap has an intermediate value. The present embodiment, therefore, will allow accurate calculation of the distance between the platen 26 and the recording head 4 without causing a cost increase.

Also, according to the present embodiment, the sheet type of the sheet P as well as whether or not the sheet P has been conveyed to a position opposed to the recording head 4 may be determined without additionally providing a sensor or the like, by detecting the outgoing light L diffusely reflected by the sheet P with the light receiving element 53. It will, therefore, be possible to achieve an improved control without causing a cost increase.

It is to be understood that the present invention should not be limited to the above described embodiment, but may be embodied in various forms without departing from the spirit and scope of the present invention.

For example, in S10, when the carriage 5 is moved to a position where the light receiving element 53 receives regularly reflected light of the outgoing light L reflected by the platen 26, it may be possible to detect the front edge of the sheet P by the fact that the light receiving element 53 no longer receives the regularly reflected light. In this case, however, it will be required to move the carriage 5 again in order to perform determination of the sheet type (S15). Since the light amount of the regularly reflected light of the outgoing light L reflected by the sheet P varies depending on the sheet type, it may also be possible to determine the sheet type based on the light amount of the regularly reflected light.

Figure 9A:
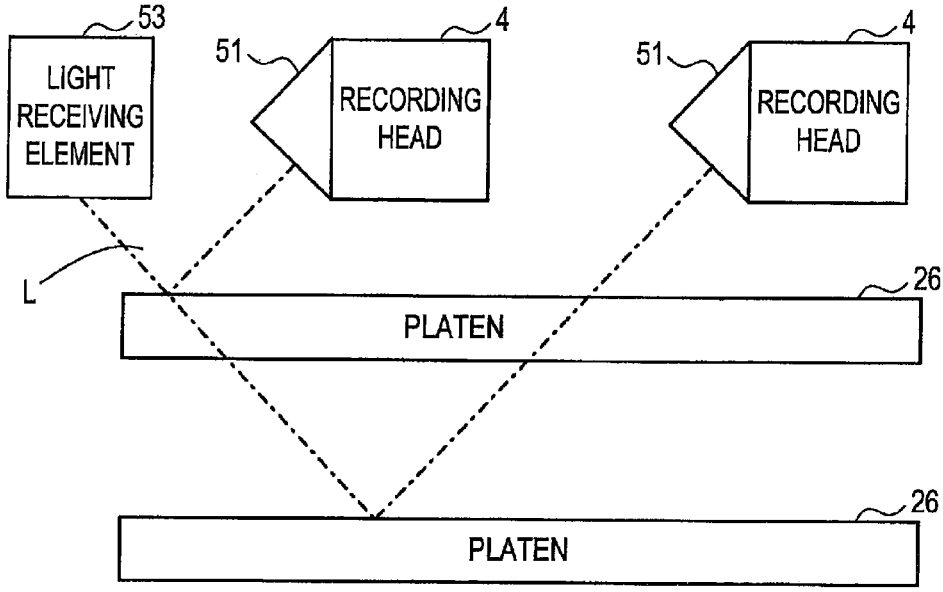
FIGS. 9A and 9B are explanatory views diagrammatically showing the principle of the process.
Figure 9B:
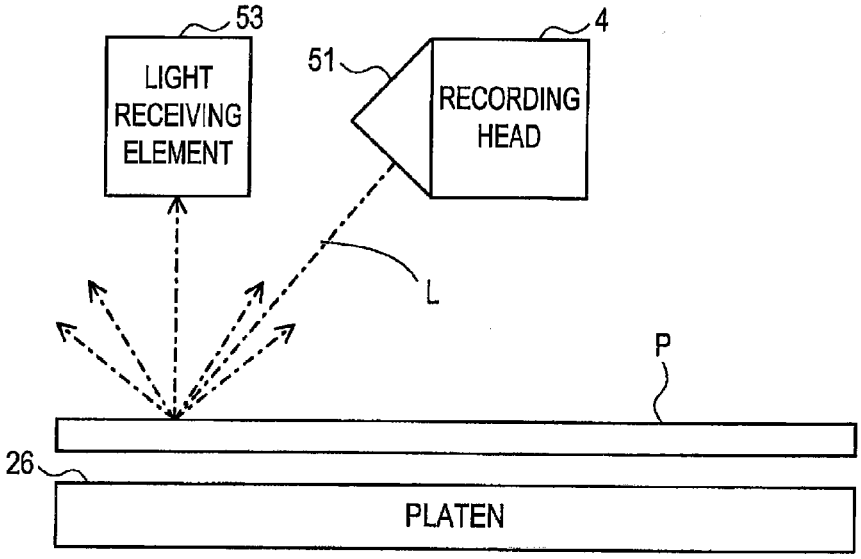

Furthermore, the same control as above may be achieved also in the case of providing the light emitting element 51 on a side of the recording head 4 and the light receiving element 53 on a side of the main frame 21 as shown in FIGS. 9A and 9B. In addition, the light emitting element 51 should not be limited to an LED, but may be one of other light emitting elements, such as a laser diode.

While the distance between the platen 26 and the recording head 4 is determined in the above described embodiment, the distance between the sheet P and the recording head 4 may be determined in the same manner. Furthermore, the ejection target medium in the present invention should not be limited to the sheet P as described above, but may be, for example, a CD-ROM or a printed circuit board.

What is claimed is:

1. A droplet ejection apparatus, comprising:

a platen on which an ejection target medium is conveyed;

a head that ejects droplets toward the platen, the head being provided in a reciprocal manner along the platen;

a light emitting device that emits a light in an oblique direction toward the platen within a plane including a straight line along a moving direction of the head and a normal line with respect to the platen;

a light receiving device that receives the light emitted from the light emitting device and regularly reflected by one of the platen and the ejection target medium; and a calculation device that calculates a distance between the one of the platen and the ejection target medium, and the head, based on a position of the head at which the light receiving device receives the light during a movement of the head, one of the light emitting device and the light receiving device being adapted to reciprocably move integrally with the head, and the other one of the light emitting device and the light receiving device being provided separately from the head, such that the one device moves towards or away from the other device as the head is provided in a reciprocal manner along the platen.

2. The droplet ejection apparatus according to claim 1, further comprising:

a first conveyance control device that conveys the head to a first position at which a state of reception of the light emitted from the light emitting device by the light receiving device changes depending on whether or not the ejection target medium has been conveyed to within the plane; and a conveying determination device that determines whether or not the ejection target medium has been conveyed to within the plane based on the state of reception of the light by the light receiving device when the first conveyance control device conveys the head to the first position.

3. The droplet ejection apparatus according to claim 2, further comprising:

a second conveyance control device that conveys the head to a second position at which the light receiving device receives the light emitted from the light emitting device and regularly or diffusely reflected by the ejection target medium; and a type determination device that determines a type of the ejection target medium based on a state of reception of the light by the light receiving device when the second conveyance control device conveys the head to the second position.

4. A droplet ejection apparatus, comprising:

a platen on which an ejection target medium is conveyed;

a head that ejects droplets toward the platen, the head being provided in a reciprocal manner along the platen;

a light emitting device that emits a light in an oblique direction toward the platen within a plane including a straight line along a moving direction of the head and a normal line with respect to the platen;

a light receiving device that receives the light emitted from the light emitting device and regularly reflected by one of the platen and the ejection target medium; and a calculation device that calculates a distance between the one of the platen and the ejection target medium, and the head, based on a position at which the light receiving device receives the light during a movement of the head, one of the light emitting device and the light receiving device being adapted to reciprocably move integrally with the head, and the other one of the light emitting device and the light receiving device being provided separately from the head, further comprising:

a setting device that sets a type of the ejection target medium;

an adjusting device that adjusts the distance between the platen and the head in accordance with the type of the ejection target medium set by the setting device; and a distance determination device that determines whether or not the distance between the platen and the head calculated by the calculation device is consistent with a distance corresponding to the type of the ejection target medium.

5. The droplet ejection apparatus according to claim 4, wherein the adjusting device includes a platen drive motor that moves the platen in vertical directions with respect to the head.

6. An image recording apparatus for recording an image by ejecting droplets onto a recording medium, comprising:

a conveying mechanism that conveys the recording medium;

a platen on which the recording medium is conveyed by the conveying mechanism;

a head that ejects droplets toward the platen, the head being provided in a reciprocal manner along the platen;

a light emitting device that emits a light in an oblique direction toward the platen within a plane including a straight line along a moving direction of the head and a normal line with respect to the platen;

a light receiving device that receives the light emitted from the light emitting device and regularly reflected by one of the platen and the recording medium; and a calculation device that calculates a distance between the one of the platen and the recording medium, and the head, based on a position of the head at which the light receiving device receives the light during a movement of the head, one of the light emitting device and the light receiving device being adapted to reciprocably move integrally with the head, and the other one of the light emitting device and the light receiving device being provided separately from the head, such that the one device moves towards or away from the other device as the head is provided in a reciprocal manner along the platen.

7. The image recording apparatus according to claim 6, further comprising:

a first conveyance control device that conveys the head to a first position at which a state of reception of the light emitted from the light emitting device by the light receiving device changes depending on whether or not the recording medium has been conveyed to within the plane; and a conveying determination device that determines whether or not the recording medium has been conveyed to within the plane based on the state of reception of the light by the light receiving device when the first conveyance control device conveys the head to the first position.

8. The image recording apparatus according to claim 7, further comprising:

a second conveyance control device that conveys the head to a second position at which the light receiving device receives the light emitted from the light emitting device and regularly or diffusely reflected by the recording medium; and a type determination device that determines a type of the recording medium based on a state of reception of the light by the light receiving device when the second conveyance control device conveys the head to the second position.

9. An image recording apparatus for recording an image by ejecting droplets onto a recording medium, comprising:

a conveying mechanism that conveys the recording medium;

a platen on which the recording medium is conveyed by the conveying mechanism;

a head that ejects droplets toward the platen, the head being provided in a reciprocal manner along the platen;

a light emitting device that emits a light in an oblique direction toward the platen within a plane including a straight line along a moving direction of the head and a normal line with respect to the platen;

a light receiving device that receives the light emitted from the light emitting device and regularly reflected by one of the platen and the recording medium; and a calculation device that calculates a distance between the one of the platen and the recording medium, and the head, based on a position at which the light receiving device receives the light during a movement of the head, one of the light emitting device and the light receiving device being adapted to reciprocably move integrally with the head, and the other one of the light emitting device and the light receiving device being provided separately from the head, further comprising:

a setting device that sets a type of the recording medium; an adjusting device that adjusts the distance between the platen and the head in accordance with the type of the recording medium set by the setting device; and a distance determination device that determines whether or not the distance between the platen and the head calculated by the calculation device is consistent with a distance corresponding to the type of the recording medium.

10. The image recording apparatus according to claim 9, wherein the adjusting device includes a platen drive motor that moves the platen in vertical directions with respect to the head.

* * * * *